US009261018B2

(12) United States Patent
Salminen

(10) Patent No.: US 9,261,018 B2
(45) Date of Patent: Feb. 16, 2016

(54) INTERNAL COMBUSTION ENGINE OF THE ANNULAR PISTON TYPE AND A CENTER SHAFT FOR SUCH AN ENGINE

(76) Inventor: Reijo Salminen, Bellingham, WA (US)

( * ) Notice: Subject to any disclaimer, the term of this patent is extended or adjusted under 35 U.S.C. 154(b) by 54 days.

(21) Appl. No.: 13/994,614

(22) PCT Filed: Dec. 16, 2011

(86) PCT No.: PCT/FI2011/051116

§ 371 (c)(1),
(2), (4) Date: Sep. 17, 2013

(87) PCT Pub. No.: WO2012/080575

PCT Pub. Date: Jun. 21, 2012

(65) Prior Publication Data

US 2013/0333659 A1 Dec. 19, 2013

Related U.S. Application Data

(60) Provisional application No. 61/423,800, filed on Dec. 16, 2010.

(51) Int. Cl.

| | |
|---|---|
| ***F02B 71/04*** | (2006.01) |
| ***F02B 77/00*** | (2006.01) |
| ***F01P 3/06*** | (2006.01) |
| ***F02B 71/00*** | (2006.01) |

(52) U.S. Cl.
CPC . *F02B 77/00* (2013.01); *F01P 3/06* (2013.01); *F02B 71/00* (2013.01)

(58) Field of Classification Search
CPC ..... F01P 3/08; F01P 3/22; F01P 3/06; F02B 71/00; F02B 77/00
USPC ..... 123/41.35–41.37, 46 R–46 H
See application file for complete search history.

(56) References Cited

U.S. PATENT DOCUMENTS

| | | | | |
|---|---|---|---|---|
| 2,848,984 | A * | 8/1958 | Flynn, Jr. | 123/41.35 |
| 2,880,709 | A * | 4/1959 | Sakraida et al. | 123/46 R |
| 3,082,754 | A * | 3/1963 | Nowell et al. | 123/46 B |
| 4,665,703 | A * | 5/1987 | David | 60/595 |
| 7,905,221 | B2 | 3/2011 | Salminen | |

FOREIGN PATENT DOCUMENTS

| | | | |
|---|---|---|---|
| DE | 3934221 | A1 * | 4/1991 |
| GB | 392840 | A | 5/1933 |
| GB | 623013 | A | 5/1949 |
| GB | 819860 | A | 9/1959 |
| WO | WO2007035084 | A1 | 3/2007 |
| WO | WO2012080575 | | 6/2012 |

* cited by examiner

*Primary Examiner* — Marguerite McMahon
(74) *Attorney, Agent, or Firm* — Seppo Laine Oy

(57) ABSTRACT

The present invention provides a novel internal combustion engine of the annular piston type and a center shaft for such an engine for further improving the cooling an internal combustion engine of the annular piston type. The internal combustion engine comprises a block having at least one annular combustion chamber and an annular piston with a center chamber. The annular piston of the engine is configured to reciprocate in the combustion chamber. The internal combustion engine further comprises a center shaft being fixed to said block and configured to fit at least partially inside the center chamber of the annular piston. The center shaft comprises at least one passageway which is configured to lead fluid flow to and from the center chamber of the annular piston.

21 Claims, 4 Drawing Sheets

INTERNAL COMBUSTION ENGINE OF THE ANNULAR PISTON TYPE AND A CENTER SHAFT FOR SUCH AN ENGINE

RELATED APPLICATIONS

The present application is a 371 of International PCT Application No. PCT/FI2011/051116 filed Dec. 16, 2011. PCT Application No. PCT/FI2011/051116 claims priority benefit of U.S. Provisional Application Ser. No. 61/423,800 filed Dec. 16, 2010

The contents of all related application listed above are incorporated herein by reference.

TECHNICAL FIELD

The present invention relates to combustion engines. In particular, the present invention relates to combustion engines having an annular piston layout. More specifically, the invention relates to obtaining mechanical energy directly from the expenditure of the chemical energy of fuel burned in an annular combustion chamber, wherein the movable annular piston is cooled with liquid in direct and continuous contact with the movable piston surface during all induction, compression, expansion, and exhaust strokes, and more particularly to a type of an internal combustion engine described in the U.S. Pat. No. 7,905,221 B2, issue date Mar. 15, 2011, for an internal combustion engine.

BACKGROUND

Internal combustion engines of the annular piston type are known from the above identified U.S. Pat. No. 7,905,221 B2 which discloses an internal combustion engine comprising a substantially cylindrical air chamber having a circumferential interior wall and a substantially round upper interior wall. The engine has an annular shaped combustion chamber having a substantially circular inner wall surface substantially concentric with the cylindrical air chamber and a substantially circular outer wall surface substantially concentric with the cylindrical air chamber. The engine further comprises a pre-combustion, fixed volume chamber in fluid communication with the annular shaped combustion chamber, and a substantially cylindrical piston comprising a first surface cooperatively configured to fit within the substantially cylindrical air chamber. The engine also comprises an air sump supply in communication with a compression chamber configured to receive compressed air there from. For a detailed description of the background art of Internal Combustion Engines reference is made to the above-identified U.S. Pat. No. 7,905,221 B2 without repeating it here.

It is a fact that a significant amount of heat is generated by combustion in the annular combustion chamber wall. The heat is cooled in the known annular piston engine by providing cooling channels in the engine block for cooling the cylinder wall.

It is therefore an object of the present invention to further improve the cooling of an internal combustion engine of the annular piston type. It is a particular aim to provide efficient cooling of the annular piston of such an engine.

SUMMARY

The aim is achieved with a novel center shaft for an internal combustion engine of the annular piston type. The center shaft is configured to fit slidably at least partially inside a center chamber of the movable annular piston. The center shaft comprises at least one passageway for providing a fluid flow to the center chamber of the piston.

More specifically, the center shaft according to the present invention is characterized by claim 1.

On the other hand the aim is achieved with a novel internal combustion engine comprising a block having at least one annular combustion chamber and an annular piston with a center chamber. The annular piston of the engine is configured to reciprocate in the combustion chamber. The internal combustion engine further comprises a center shaft being fixed to said block and configured to fit at least partially inside the center chamber of the annular piston. The center shaft comprises at least one passageway which is configured to lead fluid flow to and from the center chamber of the annular piston.

More specifically, the internal combustion engine according to the present invention is characterized by the characterizing portion of claim 19.

Considerable benefits are gained with aid of the present invention. Primarily, the piston may be cooled by virtue of the fluid flow arranged inside the piston. Since both the housing around the piston and all sides of the annular combustion chamber are cooled these prevailing conditions allow for cool, typically about 200 to 300° F., operation of the piston, seals and combustion chamber walls instead of conventional typical 500 to 600° F. temperature. Substantially higher compression ratio and combustion temperature can be used in the combustion chamber resulting in higher fuel economy and cleaner exhaust gases. Reduced heat expansion allows very tight tolerances between the cooled movable and stationary surfaces. Use of even zero gap (clearance) self-lubricating graphite seals becomes feasible.

BRIEF DESCRIPTION OF THE DRAWINGS

In the following, certain embodiments of the invention are described in greater detail with reference to the accompanying drawings in which.

DETAILED DESCRIPTION

Four main embodiments of the present invention shall be described in the following by discussing first the main components of the apparatus of the first embodiment of an internal combustion engine featuring a liquid cooled annular piston and in connection with a linear generator. The exemplary embodiment is followed by a general description of its operation. Descriptions of further embodiments of the present invention are described in the form of a linear compressor, linear positive displacement pump and rotational mechanical power generation.

Figure 2:
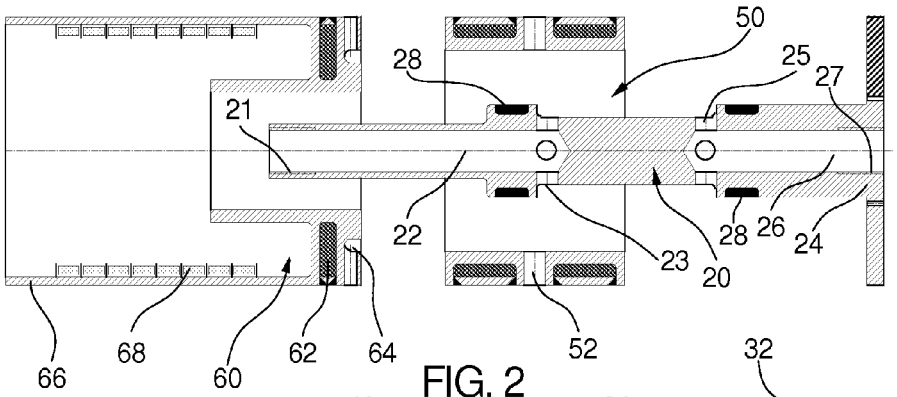
FIG. 2 shows schematically the main components of the first embodiment of the apparatus of the present invention as two assembly views.
Figure 1:
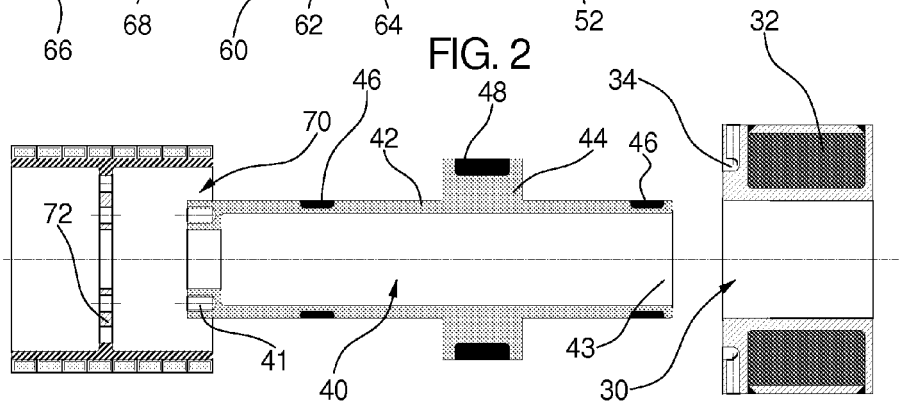
FIG. 1 shows the longitudinal cross section view of the assembly of the apparatus of the first embodiment of the present invention.
Figure 1:
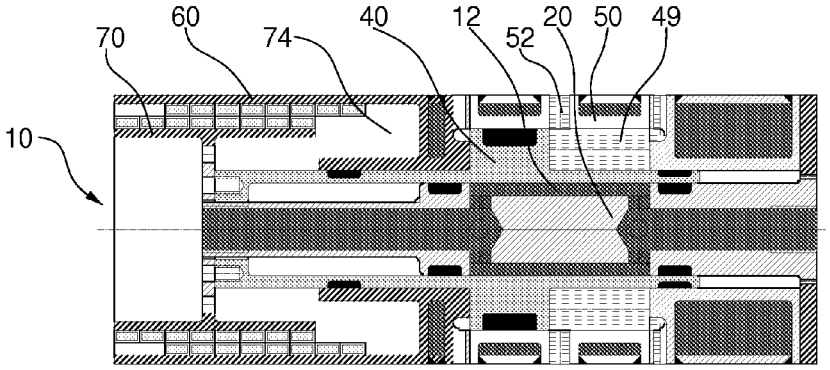

Reference is made to FIG. 1, which shows the longitudinal cross section view of the assembly of the apparatus 10 of the first embodiment of the present invention. With reference to FIG. 2, which shows schematically the main components of the first embodiment of the apparatus of the present invention, the apparatus 10 comprises a stationary—preferably water-cooled—center shaft 20, a stationary—also preferably water-cooled—engine base block 30, a double-acting movable annular shape piston 40, a stationary and preferably water-cooled annular combustion chamber block 50, a stationary and preferably water-cooled engine head block 60, and a double-acting movable annular multi-ring-shaped NdFeB permanent magnet assembly 70. The apparatus 10 is designed as a module for a conventional annular piston employing internal combustion engine, which may be equipped with a novel sub-assembly according to any of the embodiments described herein or generally as claimed in the appended claims.

With reference to FIG. 2, the stationary water-cooled center shaft 20 of the apparatus 10 is bored to form a cooling liquid inlet tube 22 with female threads 21 for connection to means of cooling liquid feed. The center shaft 20 therefore comprises an inlet portion. In this context the term water-cooled is to be understood as referring to fluid cooling generally known as water-cooling in the field. At the end of the inlet portion, the center shaft comprises an annular passage way forming portion. The said end of the cooling liquid inlet tube 22, i.e. inlet portion, the center shaft comprises radial holes 23 to let the cooling liquid pass out to an annular passage way 12 that is formed between the water-cooled center shaft 20 and the double-acting movable annular shape piston 40 arranged around it, as shown in the assembly FIG. 1. At the end opposite to the inlet portion the annular passage way forming portion has an outlet portion. The flanged base end 24 of the outlet portion of the water-cooled center shaft 20 is also bored to form a cooling liquid outlet tube 26. Said end of the annular passage way forming portion has radial holes 25 to let the cooling liquid from the annular passage way 12 between the water-cooled center shaft 20 and the double-acting movable annular shape piston 40 enter into the cooling liquid outlet tube 26. There are female threads 27 at the flanged base end 24 of the water-cooled center shaft 20 for connection to means of cooling liquid discharge from the cooling liquid outlet tube 26.

The center shaft 20 is configured to be installed in a sealed manner into the annular piston 40. According to a particularly preferable embodiment, the water-cooled center shaft 20 has two self-lubricating GraphAlloy seals 28 to form a liquid and gas tight seal between the stationary water-cooled center shaft 20 and the double-acting movable annular shape piston 40 to contain the cooling liquid in the annular passage way 12.

With reference to FIG. 1 and FIG. 2, the stationary water-cooled engine base block 30 is assembled over the stationary water-cooled center shaft 20 of the apparatus 10 against the flanged base end 24. The stationary water-cooled engine base block 30 comprises an annular shape cooling liquid chamber 32 and one or more fixed volume pre-combustion and supercharged combustion air supply chambers 34 combined with fuel injector and/or spark plug nozzles as described in greater detail in U.S. Pat. No. 7,905,221 B2 identified above.

With reference to FIG. 1 and FIG. 2, the double-acting movable annular shape piston 40 is assembled over the stationary water-cooled center shaft 20 of the apparatus 10 and inside the stationary water-cooled engine base block 30. The double-acting movable annular shape piston 40 comprises a cylindrical piston tube section 42, cooperatively configured to fit over the cylindrical water-cooled center shaft 20, a ring shaped piston section 44 protruding radially outward from the piston tube section 42 cooperatively configured to fit within the stationary water-cooled annular combustion chamber block 50. Such a piston is known in the field as annular piston from the above-identified U.S. Pat. No. 7,905,221 B2. A center chamber is therefore defined by the piston tube section 42 of the hollow annular piston 40. The head block end 41 of the cylindrical piston tube section 42 opposite from the base block end 43 inside the stationary water-cooled engine base block 30 has means to attach it to the double-acting movable annular shape permanent magnet assembly 70 which is disclosed in connection with the first embodiment of the present invention. As shall be explained hereafter, the kinetic energy of the piston 40 could also be maintained as mechanical movement and transmitted to a crankshaft, for example.

The piston is adapted in a movable but tight manner into the engine block. There are preferably two GraphAlloy seals 46 to form a gas tight zero gap (clearance) seal between the cylindrical piston tube section 42, the stationary water-cooled engine head block 60, and the stationary water-cooled engine base block 30 to contain the compressed air and combustion gases in the main and variable length annular shaped combustion chamber 49 formed between the double-acting movable annular shape piston 40 and the stationary water-cooled annular combustion chamber block 50. The combustion chamber block 50 may be a separate sub-assembly or an integral part of the main engine block 30 or head block 60. One or more GraphAlloy seals 48 in the ring shaped piston section 44 are used to seal off the combustion gases in a gas tight manner from the compressed air on opposite sides of the ring shaped piston section 44 inside the variable length annular shaped combustion chamber 49.

A specific note is made here that the term "GraphAlloy" is meant to be a generic term used in the field for self-lubricating graphite alloy seals and does not refer to any trademarked term for any specific manufacturer.

With reference to FIG. 1 and FIG. 2, the stationary water-cooled annular combustion chamber block 50 is cooperatively configured to fit over the double-acting movable annular shape piston 40 of the apparatus 10 and against the stationary water-cooled engine base block 30. There are one or more outlet ports 52 in the middle of the stationary water-cooled annular combustion chamber 50 for discharge and scavenging of the combustion gases from the annular shaped combustion chamber 49 during the exhaust strokes of the annular internal-combustion engine.

With reference to FIG. 1 and FIG. 2, the stationary water-cooled engine head block 60 is cooperatively configured to fit over the double-acting movable annular shape piston 40 of the apparatus 10 and against the stationary water-cooled annular combustion chamber block 50. The stationary water-cooled engine head block 60 comprises an annular shape cooling liquid chamber 62 and one or more fixed volume pre-combustion and supercharged combustion air supply chambers 64 combined with fuel injector and/or spark plug nozzles as is known per se from above-identified U.S. Pat. No. 7,905,221 B2.

Inside the cylindrical shell 66 of the head block 60 there is a multi-coil stator 68 that is used to create a magnetic field that translates linearly, rather than rotates. The coils are pulsed on so the region of the magnetic field moves in sync with the double-acting movable annular shape permanent magnet assembly 70 to create an electric current.

With reference to FIG. 1 and FIG. 2, the double-acting movable annular multi-ring-shaped NdFeB permanent magnet assembly 70 is cooperatively configured to fit inside the cylindrical shell 66 and the set of coils 68 in the stationary water-cooled engine head block 60. Inside the double-acting movable annular shape permanent magnet assembly 70 there is a flange 72 to facilitate the attachment of the permanent magnet assembly 70 to the end 41 of the double-acting movable annular shape piston 40. The flange 72 is perforated to allow air transfer in and out of the variable size annular chamber 74 that is formed between the stationary water-cooled engine head block 60 and the double-acting movable annular shape permanent magnet assembly 70. The air flow also provides additional cooling of the variable size annular chamber 74.

Tie-rods or other conventional means are used to connect and hold the stationary components of the present invention together in the axial direction.

Conventional means are used in connection with the multi-coil stator 68 in the stationary water-cooled engine head block 60 to create a magnetic field that translates linearly, rather than rotates. The coils are pulsed on so the region of the magnetic field moves in sync with the double-acting movable annular shape permanent magnet assembly 70 to create an electric current. The coils are connected to inverters which convert the generator output to direct current. The inverters are controlled by a digital signal processor system maximizing the efficiency of the power conversion process.

The linear generator assembly acts as a linear starter motor when starting the liquid cooled annular piston internal-combustion engine. Since the internal engine of an annular piston type generates a significant amount of pressurized air, the engine may alternatively be started by virtue of said pressurized air. Namely, the engine may be started by running the engine in a forced manner by feeding air and fuel into the combustion chamber from the fuel and pressurized air reservoirs (not shown).

Liquid Cooled Annular Piston

Conventional means are used to circulate the cooling liquid through the stationary water-cooled center shaft 20. While the cooling liquid flows through the annular passage way 12, this cooling liquid chamber 12 allows constant and direct contact between the cooling liquid and the inside cylindrical surface of the double-acting movable annular shape piston 40.

Since both the housing around the cylindrical piston tube section 42, and all sides of the annular combustion chamber 49, are also water-cooled, these prevailing conditions allow for cool, typically 200 to 300° F., operation of the piston, seals and combustion chamber walls instead of conventional typical 500 to 600° F. temperature. Substantially higher compression ratio and combustion temperature can be used in the combustion chamber resulting in higher fuel economy and cleaner exhaust gases. Reduced heat expansion allows very tight tolerances between the cooled movable and stationary surfaces. Use of even zero gap (clearance) self-lubricating graphite seals becomes feasible.

Even though this first embodiment of the present invention shows the cooling liquid inlet and outlet at opposite ends of the stationary water-cooled center shaft 20, it is also possible to use the same cooling liquid circulation path as shown in the next embodiments of the present invention, where cooling liquid inlet and outlet ports are at the same end in the stationary water-cooled center shaft 20.

Annular Internal-Combustion Engine

Figure 3:
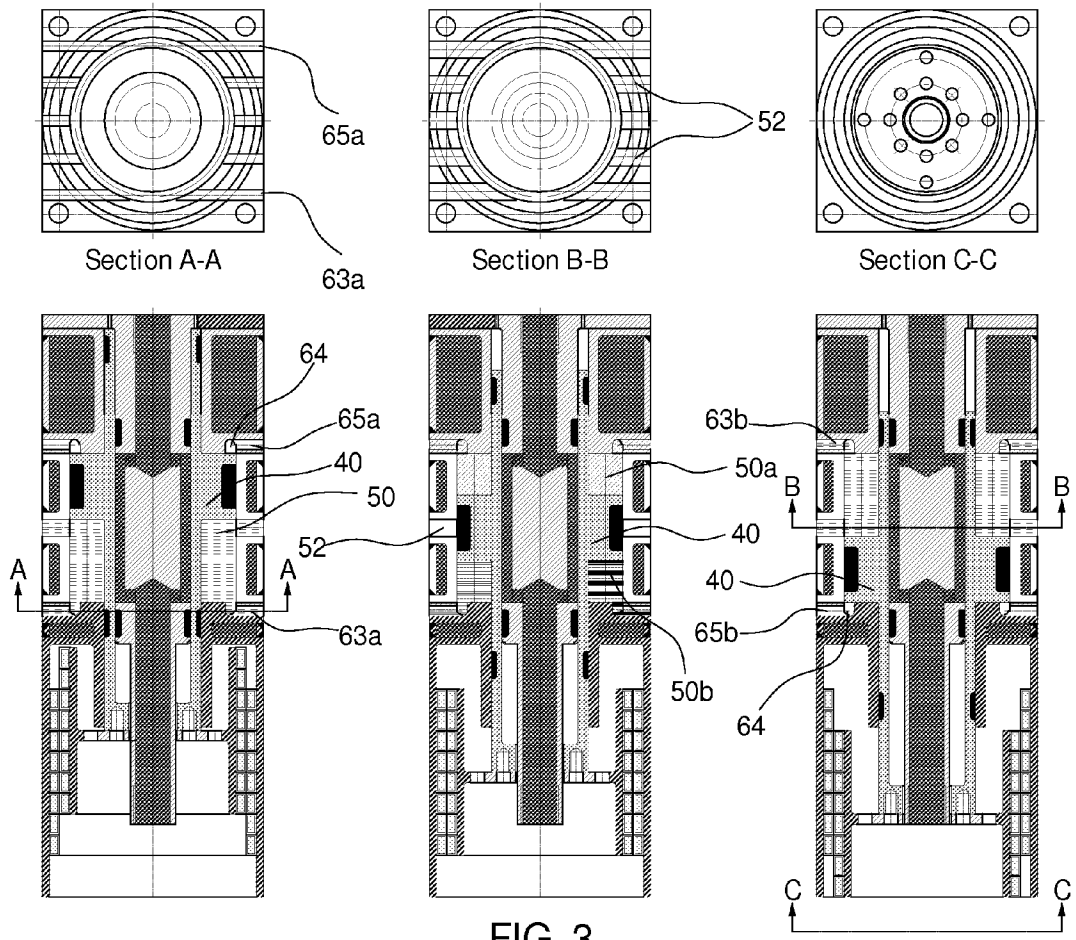
FIG. 3 shows schematically the assembly of the apparatus of the first embodiment of the present invention during three different stages of operation.

FIG. 3 shows schematically the assembly of the apparatus of the first embodiment of the present invention during three different stages of operation.

The left hand side longitudinal cross section view of the assembly below cross Section A-A shows the double-acting movable annular shape piston 40 in the extreme extracted position, where the supercharged combustion air supply port 63*a* is providing the exhaust gas scavenging operation and the induction of combustion air, while the fuel injector port 65*a* in the fixed volume pre-combustion chamber 64 is providing the fuel into the combustion air at the end of the upward compression cycle to begin the next expansion cycle.

The center longitudinal cross section view of the assembly below cross Section B-B shows the double-acting movable annular shape piston 40 in the middle stroke position, where it is blocking the exhaust outlet ports 52 in the middle of the stationary water-cooled annular combustion chamber 50. The expanding combustion gases 50*a* above the annular shape piston 40 power the expansion stroke, while the fresh combustion air 50*b* is being compressed under the annular shape piston 40.

The right hand side longitudinal cross section view of the assembly below cross Section C-C shows the double-acting movable annular shape piston 40 in the extreme extended position, where the supercharged combustion air supply port 63*b* is providing the exhaust gas scavenging operation and the induction of combustion air, while the fuel injector port 65*b* in the fixed volume pre-combustion chamber 64 is providing the fuel into the combustion air at the end of the downward compression cycle to begin the next expansion cycle.

For the detailed description of the operation of the annular internal-combustion engine that is used in this first embodiment of the present invention, please refer to the above identified U.S. Pat. No. 7,905,221 B2.

Emission Analysis

Since the liquid-cooled piston allows cooler internal surface operation, higher compression ratio, and therefore, higher combustion temperature, the EMISSION ANALYSIS paragraph of the above-identified U.S. Pat. No. 7,905,221 B2 will be repeated in the following with minor modifications.

One preferable feature for the high thermal efficiency and practically no carbon monoxide, hydrocarbon or nitrogen oxide emissions from the apparatus of the present invention is the use of the liquid cooled annular piston, high compression ratio, and practically zero gap seals in combination with the dual fixed volume combustion chambers. A pre-combustion chamber receives a rich fuel-air mixture while the supercharged annular combustion air chamber is charged with a very lean mixture or none at all. The rich mixture ignites the lean main mixture. The resulting peak temperature is low enough to inhibit the formation of nitrogen oxides, and the mean temperature is sufficiently high to limit emissions of carbon monoxide and hydrocarbon. The fuel/air ratio varies from rich at the pre-combustion chamber to lean at the annular shape combustion chamber.

It is the peak temperature, which occurs at the tip of the flame front, that produce most of the nitrogen oxide emissions; the lower the peak temperatures the lower the nitrogen oxide emissions. When the piston is racing away from the flame front it produces a cooling effect that results in lower peak temperatures and lower nitrogen oxide emissions. It is a well-known fact that combustion efficiencies can be improved by running lean, significantly above 14.5 to 1 air/fuel ratio.

The annular shape combustion chamber in combination with the tangential entry of the flame front from both the pre-combustion chamber and the supercharged annular combustion air supply chamber produce a massive turbulence that results in an extremely fast burn rate (combustion duration).

Burn rate is the amount of time it takes for the trapped fuel/air mixture to completely combust. Burn rate is a powerful multiplier of engine efficiency.

Description of the Second Embodiment

Figure 4:
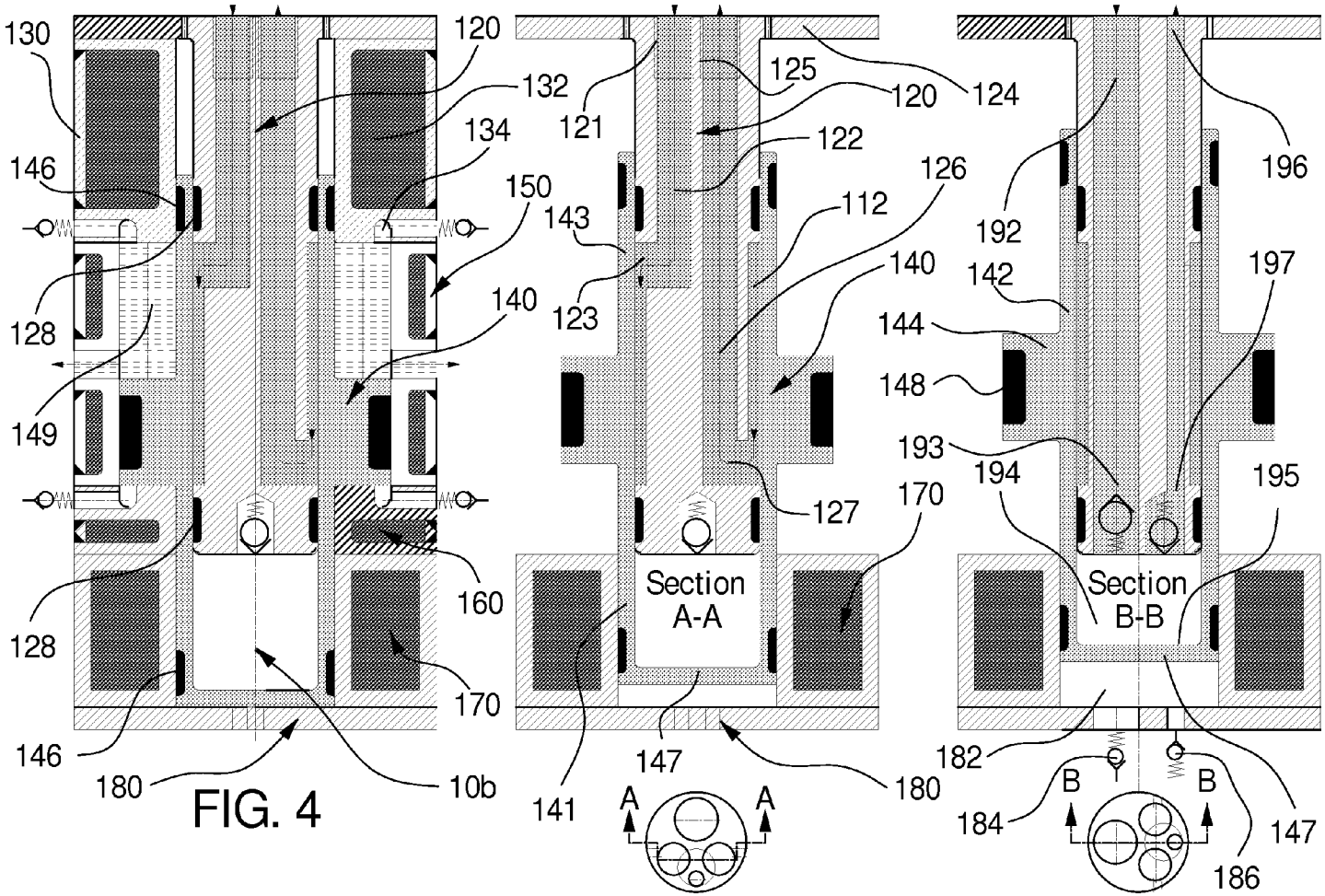
FIG. 4 shows schematically the main components of the second and third embodiment of the apparatus of the present invention.

Reference is made to FIG. 4, which shows the longitudinal cross section view of the assembly of the apparatus 10*b* of the second embodiment of the present invention. The apparatus 10*b* comprises a stationary water-cooled center shaft 120, a stationary water-cooled engine base block 130, a double-acting movable annular shape piston 140, a stationary water-cooled annular combustion chamber block 150, a stationary water-cooled engine head block 160, a stationary water-cooled compressor chamber 170, and a compressor chamber head cover 180. Unlike in the first embodiment, one end of the piston 140 is closed by a piston head 147 for making the piston 140 suitable as a compression piston for producing compressed air. A first cylindrical compression chamber 194 of variable volume is therefore formed between the movable piston head 147 and the terminal end 193 of the stationary center shaft 120.

With reference to FIG. 4, the flanged base end 124 of the stationary water-cooled center shaft 120 of the apparatus 10*b* is bored to form a cooling liquid inlet tube 122 with female threads 121 for connection to means of cooling liquid feed. The other end of the cooling liquid inlet tube 122 has a radial passageway 123 to let the cooling liquid pass into the beginning end of the annular passage way 112 that is formed between the water-cooled center shaft 120 and the double-acting movable annular shape piston 140, as shown in the Section A-A of FIG. 4. Another passage way is bored into the stationary water-cooled center shaft 120 to form a cooling liquid outlet tube 126 with female threads 125 for connection to means of cooling liquid discharge from the cooling liquid outlet tube 126. The other end of the cooling liquid outlet tube 126 has a radial passage way 127 to let the cooling liquid flow in from the end of the annular passage way 112 that is formed between the water-cooled center shaft 120 and the double-acting movable annular shape piston 140, as shown in the Section A-A of FIG. 4. Therefore in the second embodiment, the inlet and outlet portions of the center shaft are combined by having the inlet and outlet tubes run parallel to and from the annular passage way 112.

With reference to FIG. 4, Section B-B, the stationary water-cooled center shaft 120 of the apparatus 10*b* is also bored to form an air inlet tube 192 with conventional means to connect it to a clean supply air source. The air inlet tube 192 runs the entire length of the stationary center shaft 120 all the way to the inside compression chamber 194 that is formed between the inside terminal end 193 of the stationary center shaft 120 opposing the flange based end 124 and the inside surface 195 of the compressor piston head 147. There is a check valve in said inside terminal end 193 of the air inlet tube 192 to let air into the inside compression chamber 194 only during the induction stroke.

With reference to FIG. 4, Section B-B, the stationary water-cooled center shaft 120 of the apparatus 10*b* is also bored to form a compressed air outlet tube 196 with conventional means to connect it to a compressed air accumulator or other receiving apparatuses. The compressed air outlet tube 196 runs the entire length of the stationary center shaft 120 all the way from the inside compression chamber 194 to the flanged base end 124 of the stationary center shaft 120. There is a check valve in the inside end 197 of the air outlet tube 196 to let compressed air out from the inside compression chamber 194 during the compression stroke.

The water-cooled center shaft 120 has two self-lubricating GraphAlloy seals 128 to form a liquid and gas tight seal between the stationary water-cooled center shaft 120 and the double-acting movable annular shape piston 140 to contain the cooling liquid in the annular passage way 112.

With reference to FIG. 4, the stationary water-cooled engine base block 130 is assembled over the stationary water-cooled center shaft 120 of the apparatus 10*b* against the flanged base end 124. The stationary water-cooled engine base block 130 comprises an annular shape cooling liquid chamber 132 and one or more fixed volume pre-combustion and supercharged combustion air supply chambers 134 combined with fuel injector and/or spark plug nozzles as described in the above identified U.S. Pat. No. 7,905,221 B2.

With reference to FIG. 4, the double-acting movable annular shape piston 140 is assembled over the stationary water-cooled center shaft 120 of the apparatus 10*b* and inside the stationary water-cooled engine base block 130. The double-acting movable annular shape piston 140 comprises a cylindrical piston tube section 142, cooperatively configured to fit over the cylindrical water-cooled center shaft 120, a ring shaped piston section 144 protruding outward from the piston tube section 142 cooperatively configured to fit within the stationary water-cooled annular combustion chamber 150. The end 141 of the cylindrical piston tube section 142 opposite from the end 143 inside the stationary water-cooled engine base block 130 is closed to form a compressor piston head 147 of this second embodiment of the present invention. There are two GraphAlloy seals 146 to form a gas tight zero gap (clearance) seal between the cylindrical piston tube section 142, the stationary water-cooled engine head block 160, and the stationary water-cooled engine base block 130 to contain the compressed air and combustion gases in the main and variable length annular shaped combustion chamber 149 formed between the double-acting movable annular shape piston 140 and the stationary water-cooled annular combustion chamber block 150. One or more GraphAlloy seals 148 in the ring shaped piston section 144 are used to seal off gas tight the combustion gases from the compressed air on opposite sides of the ring shaped piston section 144 inside the variable length annular shaped combustion chamber 149.

A specific note is made here that the term "GraphAlloy" is meant to be a generic term used in the field for self-lubricating graphite alloy seals and does not refer to any trademarked term for any specific manufacturer.

Since the descriptions of the stationary water-cooled annular combustion chamber block 150 and the stationary water-cooled engine head block 160, are in principal the same as described earlier in the first embodiment of the present invention, the text is not repeated here.

With reference to FIG. 4, Section B-B, the stationary water-cooled compressor chamber 170, the compressor chamber head cover 180, and the compressor piston head 147 form a second (outside) compression chamber 182. There is a check valve 184 in the compressor chamber head cover 180 to let air into the second outside compression chamber 182 only during the induction stroke. Another check valve 186 is in the compressor chamber head cover 180 to let compressed air out from the second outside compression chamber 182 during the compression stroke.

Tie-rods or other conventional means are used to connect and hold the stationary components of the present invention together in the axial direction.

The operation of the apparatus 10*b* of the second embodiment of the present invention is similar to the operation described earlier in connection with the first embodiment and will therefore not be repeated here.

It is to be understood that the reference to use the second embodiment as an air compressor applies also to compressing any other type of gas or fluid medium as well.

According to a further alternative embodiment, the second embodiment presented in FIG. 4 may be modified for producing both compressed air and rotational movement to be transmitted to a crankshaft, for example. By removing the compressor chamber head cover 180 and therefore also the second compression chamber 182, the piston 140, particularly the piston head 147, may be provided with a connecting rod (not shown) for transmitting kinetic energy to a crankshaft (not shown). In such an embodiment, compressed air would be produced only by the first compression chamber 194, while also producing traditional rotational movement for driving the transmission of a motor vehicle.

This particular embodiment would be most feasible when running a plurality of pistons in a multi-cylinder layout, wherein pressure variations created in the crank chamber are evened out.

Description of the Third Embodiment

The apparatus of the third embodiment of the present invention (not shown) has in principal the same components as the second embodiment except that the apparatus is used as a linear positive displacement pump to pressurize and move liquids.

The general description of the apparatus of the third embodiment of the present invention is in principal the same as in the second embodiment except that the apparatus is used as a linear positive displacement pump to pressurize and move liquids.

Description of the Fourth Embodiment

Figure 5:
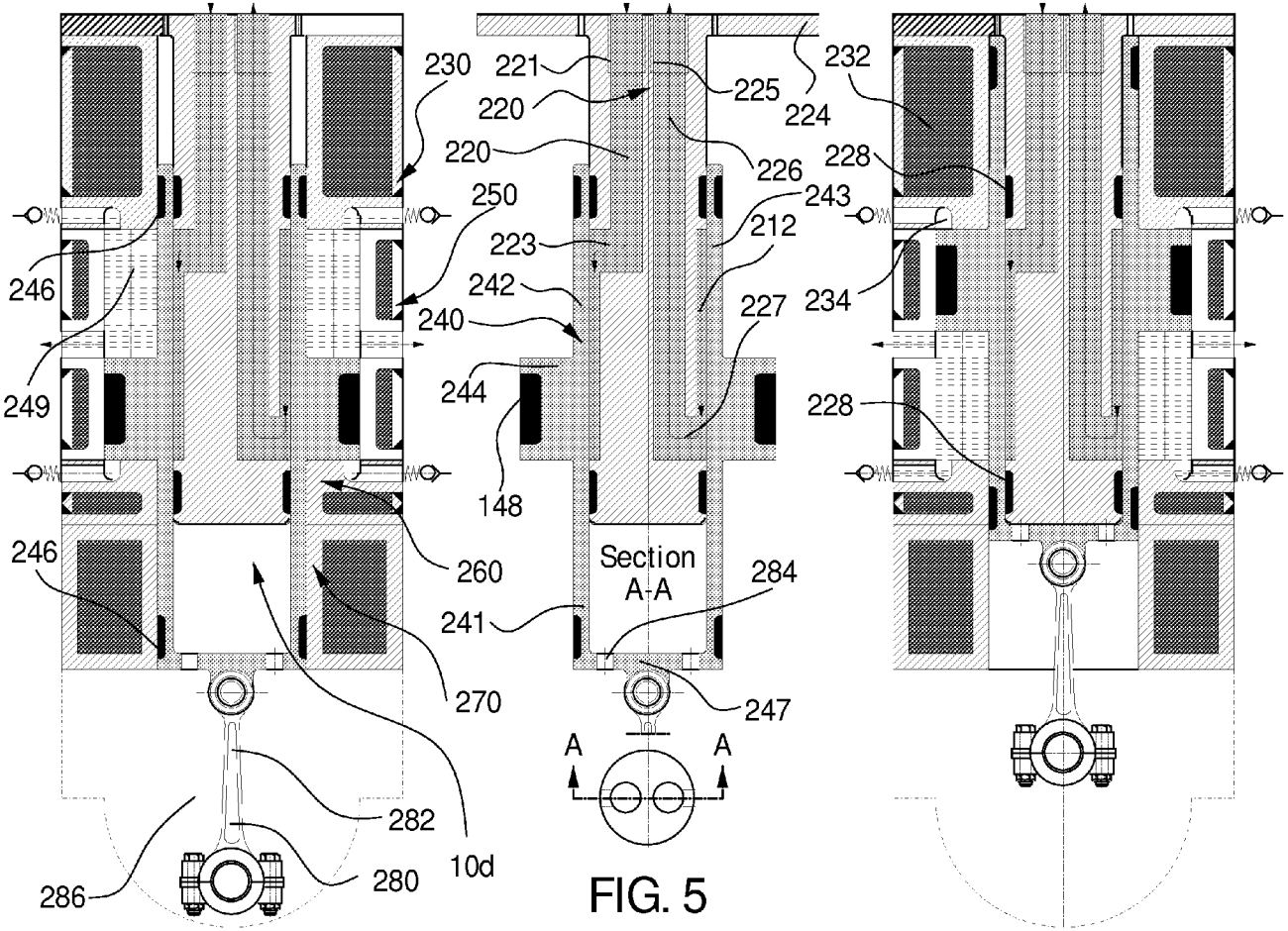
FIG. 5 shows schematically the main components of the fourth embodiment of the apparatus of the present invention.

Reference is made to FIG. 5, which shows the longitudinal cross section view of the assembly of the apparatus 10*d* of the fourth embodiment of the present invention. The apparatus 10*d* comprises a stationary water-cooled center shaft 220, a stationary water-cooled engine base block 230, a double-acting movable annular shape piston 240, a stationary water-cooled annular combustion chamber block 250, a stationary water-cooled engine head block 260, a stationary water-cooled engine block 270, and a conventional crankshaft assembly 280.

With reference to FIG. 5, the flanged base end 224 of the stationary water-cooled center shaft 220 of the apparatus 10*d* is bored to form a cooling liquid inlet tube 222 with female threads 221 for connection to means of cooling liquid feed. The other end of the cooling liquid inlet tube 222 has a radial passage way 223 to let the cooling liquid pass into the beginning end of the annular passage way 212 that is formed between the water-cooled center shaft 220 and the double-acting movable annular shape piston 240, as shown in the Section A-A of FIG. 5. Another passage way is bored into the stationary water-cooled center shaft 220 to form a cooling liquid outlet tube 226 with female threads 225 for connection to means of cooling liquid discharge from the cooling liquid outlet tube 226. The other end of the cooling liquid outlet tube 226 has a radial passage way 227 to let the cooling liquid flow in from the end of the annular passage way 212 that is formed between the water-cooled center shaft 220 and the double-acting movable annular shape piston 240, as shown in the Section A-A of FIG. 5.

The water-cooled center shaft 120 has two self-lubricating GraphAlloy seals 228 to form a liquid and gas tight seal between the stationary water-cooled center shaft 220 and the double-acting movable annular shape piston 240 to contain the cooling liquid in the annular passage way 212.

With reference to FIG. 5, the stationary water-cooled engine base block 230 is assembled over the stationary water-cooled center shaft 220 of the apparatus 10*d* against the flanged base end 224. The stationary water-cooled engine base block 230 comprises an annular shape cooling liquid chamber 232 and one or more fixed volume pre-combustion and supercharged combustion air supply chambers 234 combined with fuel injector and/or spark plug nozzles as described in the above-identified U.S. Pat. No. 7,905,221 B2.

With reference to FIG. 5, the double-acting movable annular shape piston 240 is assembled over the stationary water-cooled center shaft 220 of the apparatus 10*d* and inside the stationary water-cooled engine base block 230. The double-acting movable annular shape piston 240 comprises a cylindrical piston tube section 242, cooperatively configured to fit over the cylindrical water-cooled center shaft 220, a ring shaped piston section 244 protruding outward from the piston tube section 242 cooperatively configured to fit within the stationary water-cooled annular combustion chamber 250. The end 241 of the cylindrical piston tube section 242 opposite from the end 243 inside the stationary water-cooled engine base block 230 is closed to form a piston head 247 of this fourth embodiment of the present invention. The piston head 247 has perforations 284 for air passage during the movement of the double-acting movable annular shape piston 240 to maintain a steady pressure in the crankshaft chamber 286.

The piston head 247 is attached by conventional means to a conventional piston rod 282 which, together with a conventional crankshaft assembly 280, converts the linear movement of the double-acting movable annular shape piston 240 into rotational mechanical power.

There are two GraphAlloy seals 246 to form a gas tight zero gap (clearance) seal between the cylindrical piston tube section 242, the stationary water-cooled engine head block 260, and the stationary water-cooled engine base block 230 to contain the compressed air and combustion gases in the main and variable length annular shaped combustion chamber 249 formed between the double-acting movable annular shape piston 240 and the stationary water-cooled annular combustion chamber 250. One or more GraphAlloy seals 148 in the ring shaped piston section 244 are used to seal off gas tight the combustion gases from the compressed air on opposite sides of the ring shaped piston section 244 inside the variable length annular shaped combustion chamber 249.

A specific note is made here that the term "GraphAlloy" is meant to be a generic term for self-lubricating graphite alloy seals and does not refer to any trademarked term for any specific manufacturer.

Since the descriptions of the stationary water-cooled annular combustion chamber 250 and the stationary water-cooled engine head block 260, are in principal the same as described earlier in the first embodiment of the present invention, the text is not repeated here.

Tie-rods or other conventional means are used to connect and hold the stationary components of the present invention together in the axial direction.

The operation of the apparatus 10*d* of the fourth embodiment of the present invention is similar to the operation described earlier in connection with the first embodiment and will therefore not be repeated.

From the above it is clear that the apparatus 10 in its various embodiments features a stationary center a center shaft provided at least partially inside a movable annular piston and comprising inner passage ways for providing a fluid flow inside the piston. In the first and fourth embodiment the fluid flow was used for cooling the piston, in the second embodiment the fluid flow was used for producing compressed air, and in the third embodiment the fluid flow was used for pumping a liquid. As also described, the novel inner passage way forming center shaft may be adapted to produce one or a plurality of different fluid flows for different purposes and it may be configured to act in connection with a conventional combustion engine for driving a mechanical transmission, or for producing electrical energy (cf. FIGS. 1 to 3), or for compressing fluids or any combination thereof. Indeed the passage ways provide for both auxiliary and principal fluid flows alike.

What is claimed is:

1. A center shaft for an internal combustion engine, the internal combustion engine having a movable annular piston defining a piston chamber, the center shaft comprising:

at least one passageway for providing a fluid flow to the piston chamber, an inlet passage way, an outlet passage way, an annular passage way forming portion defining an annular passage way between the center shaft and the surrounding piston, the annular passage way connecting the inlet passage way and outlet passage way, wherein the center shaft is configured to fit at least partially inside the piston chamber such that the movable annular piston may slide over an outer surface of the center shaft.

2. A center shaft as recited in claim 1, wherein the center shaft is configured to be fixed to an engine block.

3. A center shaft as recited in claim 1, wherein the center shaft comprises an inlet portion for channeling a fluid flow to inside of the piston chamber and an outlet portion for channeling said fluid flow to outside the piston chamber.

4. A center shaft as recited in claim 2, wherein the center shaft comprises an inlet portion for channeling a fluid flow to inside of the piston chamber and an outlet portion for channeling said fluid flow to outside the piston chamber.

5. A center shaft as recited in claim 3, wherein the inlet and outlet portion comprising bores for forming inlet and outlet passageways.

6. A center shaft as recited in claim 4, wherein the inlet and outlet portion comprising bores for forming inlet and outlet passageways.

7. A center shaft as recited in claim 1, wherein the inlet and outlet passage ways are connected to the annular passage way by radial openings, such as bores.

8. A center shaft as recited in claim 7, wherein the center shaft comprises at least one seal for forming a fluid tight seal between the stationary center shaft and the annular piston to contain the cooling liquid in the annular passage way.

9. A center shaft as recited in claim 8, in which the seal comprises at least one self-lubricating graphite alloy seals for engaging with the surrounding piston.

10. A center shaft as recited in claim 8, wherein the at least one seal comprises first and second seals arranged to close both ends of the annular passage way.

11. A center shaft as recited claim 7, wherein the annular passage way forming portion is arranged between an inlet portion and outlet portion, wherein the annular passageway forming portion, the inlet portion, and the outlet portion form three linear sections with at least two different diameters and substantially circular outer walls, where a middle section has the smallest diameter, a passage way extends axially through both of the end sections to reach the start of the middle section, a radial passage way at the end of the inlet and outlet passageways communicates with the ends of the annular passage way to penetrate through the outer surface of the smaller diameter middle section, and two self-lubricating graphite alloy seals imbedded into the larger diameter end sections just before the start of the smaller diameter middle section, leaving the radial passage ways open, and cooperatively configured to fit liquid-tight inside a substantially circular inner wall surface of the annular piston.

12. A center shaft as recited in claim 7, wherein the inlet and outlet passageways are arranged as parallel axial passage ways inside the center shaft.

13. A center shaft as recited in claim 12, wherein, the center shaft comprises:

two passage ways axially through the same end section of the shaft so that one passage way will reach the start of the smaller diameter section and the other passage way the end of the smaller diameter section;

a radial passage way at the end of both axial passage ways to communicate with the outer surface of the smaller diameter section;

two self-lubricating graphite alloy seals imbedded into the larger diameter end sections just before both ends of the smaller diameter section, leaving the radial passage ways open, and cooperatively configured to fit fluid-tight inside the substantially circular inner wall surface of the double-acting moving annular shape piston of the internal combustion engine.

14. A center shaft as recited in claim 1, wherein the passage ways form a cooling channel being adapted to carry cooling fluid for flushing the annular piston.

15. A center shaft as recited in claim 1, wherein the center shaft comprises inlet and outlet passage ways for transmitting fluid to a compression chamber defined by the terminal end of the center shaft and an inside surface of the annular piston.

16. A center shaft as recited in claim 15, wherein the inlet and outlet passage ways are formed by:

a bore hole extending axially through the center shaft to form a passage way for at least one of air, gas, and liquid to flow into the inside compression chamber formed between the end surface of the center shaft and an inside surface of the annular piston, and another bore hole axially through the water cooled center shaft to form a passage way for at least one of air, gas, and liquid to flow out from the inside compression chamber formed between the end surface of the center shaft and an inside surface of the annular piston.

17. A center shaft as recited in claim 16, wherein the center shaft further comprises a flow controller for controlling flow of the fluid in the compression chamber to and from the inlet and outlet passage ways.

18. A center shaft as recited in claim 17, wherein the flow controller comprises at least one of a seated poppet valve or a check valve.

19. A center shaft as recited in claim 1, wherein the piston chamber is a through hole.

20. An internal combustion engine comprising:

a block having at least one annular combustion chamber;

an annular piston with a center chamber, the piston being configured to reciprocate in the combustion chamber; and a center shaft fixed to said block and configured to fit at least partially inside the center chamber of the annular piston, the center shaft comprising at least one passageway configured to allow fluid flow to and from the center chamber of the annular piston; wherein the center shaft comprises an annular passage way forming portion defining an annular passage way between the center shaft and the surrounding piston, the annular passage way connecting the inlet and outlet passage ways.

21. A method of cooling an internal combustion engine having a movable annular piston defining a piston chamber, comprising the steps of:

providing a center shaft defining at least one passageway and an annular passage way forming portion defining an annular passage way;

arranging the center shaft to fit slidably at least partially inside the piston chamber such that the at least one passageway provides a fluid flow between the piston chamber and the center shaft, and the annular passageway extends between the center shaft and the surrounding piston to connect inlet and outlet passage ways.

* * * * *